US005775116A

United States Patent [19]

Matsumoto et al.

[11] Patent Number: 5,775,116

[45] Date of Patent: Jul. 7, 1998

[54] DEFROSTING CONTROL METHOD FOR AIR CONDITIONER

[75] Inventors: Satoshi Matsumoto, Ota; Hikaru Katsuki, Kiryu; Masayuki Shimizu, Gunma, all of Japan

[73] Assignee: Sanyo Electric Co., Ltd., Osaka, Japan

[21] Appl. No.: 837,252

[22] Filed: Apr. 10, 1997

[30] Foreign Application Priority Data

Apr. 9, 1996 [JP] Japan ..... 8-111137

[51] Int. Cl.[6] ..... F24F 11/02

[52] U.S. Cl. ..... 62/155; 62/156; 62/324.5; 62/160; 62/128

[58] Field of Search ..... 62/155, 156, 140, 62/128, 126, 129, 160, 180, 81, 278, 157, 158, 234, 324.5, 154, 151

[56] References Cited

U.S. PATENT DOCUMENTS 3,777,505 12/1973 Otaki ..... 62/160 X 4,338,790 7/1982 Saunders et al. ..... 62/156 X 4,974,417 12/1990 Levine et al. ..... 62/160 X 5,156,010 10/1992 Inoue et al. ..... 62/156 X

*Primary Examiner*—Harry B. Tanner

*Attorney, Agent, or Firm*—Darby & Darby

[57] ABSTRACT

A defrosting control method wherein an indoor unit determines whether a drop in the temperature gradient of an indoor side heat exchanger has been caused by a heavy load protecting operation or frosting of the outdoor heat exchanger during a reverse cycle heating operation of a two-unit-type air conditioner. The defrosting control is not triggered when the heavy load protecting operation is being carried out, and the defrosting control is started when predetermined conditions are satisfied, including the temperature of the indoor heat exchanger being below a raised predetermined temperature during a heavy load protecting operating.

4 Claims, 4 Drawing Sheets

DEFROSTING CONTROL METHOD FOR AIR CONDITIONER

BACKGROUND OF THE INVENTION

1. Field of the Invention

The present invention relates to a defrosting control method in the reverse cycle heating operation mode of a two-unit-type air conditioner.

2. Description of Related Art

There has conventionally been known a two-unit-type air conditioner composed of an outdoor unit and an indoor unit. The air conditioner performs cooling by using refrigerant, while it operates in a heating mode to heat a room by using a heat pump.

When the outdoor temperature goes down to +5 degrees Celsius, while the air conditioner is operating in the reverse cycle heating operation mode, the evaporating temperature of the refrigerant in an outdoor side heat exchanger becomes 0 degree Celsius or lower, causing frosting in which the moisture in the air turns into frost and adheres to the heat exchanger. If the frost is left unremoved, the frost builds up and eventually paralyzes the ventilation of the heat exchanger, thus disabling the heat exchanger from drawing outdoor air. The frosting problem is an inevitable problem with the reverse cycle heating operation of the air conditioner, and defrosting must be carried out to prevent the frosting problem.

As one of the defrosting methods in such a case, a reverse cycle defrosting method has been employed. According to the reverse cycle defrosting method, the refrigerating cycle is switched from a heating operation mode to a cooling operation mode during the heating operating mode so as to let a high temperature refrigerant gas, which is discharged from a compressor, flow into a frosted outdoor side heat exchanger, thereby melting the frost by the heat.

An air conditioner has a recommended set temperature range, if a set temperature exceeds the recommended range or if the temperature of outside air is high, then the air conditioner will be placed under heavy load, leading to a problem. For instance, in the reverse cycle heating operation mode, if the temperature is set to a high level when the room temperature is already high, then the air conditioner would be subject to heavy load. As preventive measures for heavy load, the outdoor fan is brought to a halt and the number of revolutions of the indoor fan is increased at the same time.

The indoor unit is equipped with a temperature detecting means based on a microcomputer, whereas the outdoor may be a simple type which merely turns ON or OFF an induction motor which drives a compressor and has no means such as a microcomputer. In this simple type, the outdoor unit is not provided with a function for detecting heavy load or frost.

Thus, when this type of two-unit-type air conditioner employing the simple outdoor unit, which does not have a microcomputer or other similar means and which merely turns ON or OFF the induction motor, performs the reverse cycle heating operation, frosting cannot be detected through the outdoor unit.

When the outdoor fan is stopped and the number of revolutions of the indoor fan is increased to prevent the heavy load problem, the temperature gradient of the indoor side heat exchanger decreases; hitherto, it has not been able to determine whether such a drop in the temperature gradient is due to frosting or the corrective action taken against heavy load. Further, if both heavy load and frosting have occurred, then the heavy load has to be corrected first, then the defrosting is preformed thereafter.

SUMMARY OF THE INVENTION

Accordingly, it is an object of the present invention to provide a defrosting control method for an inexpensive, two-unit-type air conditioner in which an indoor unit is capable of determining, in a reverse cycle heating operation, whether a drop in the temperature gradient of an indoor side heat exchanger has been caused by the operation for correcting a heavy load or frosting, so that it disables defrosting control during the operation for correcting a heavy load and it begins the defrosting control under a predetermined condition.

Specifically, according to the defrosting control method for the air conditioner in accordance with the present invention, while a heavy load protecting function is operating, the judgment standard for detecting the frost on the outdoor side heat exchanger is changed and the heavy load protecting function is given a priority over the defrosting of an outdoor side heat exchanger during the reverse cycle heating operation of a two-unit-type air conditioner wherein: (1) When the temperature of the indoor side heat exchanger has risen to a predetermined heavy load protecting operatable temperature during the reverse cycle heating operation, the heavy load protecting function is activated to stop the outdoor fan and increase the number of revolutions of the indoor fan. (2) When the temperature of the indoor side heat exchanger has dropped to a predetermined release temperature, the heavy load protecting function is disengaged. (3) When the temperature of the indoor side heat exchanger is a predetermined set frost detecting temperature or below and the temperature gradient of the indoor side heat exchanger has dropped to a predetermined value or below, the frosting of the outdoor side heat exchanger is detected and defrosting is started.

Further, according to the present invention, while the heavy load protecting function is in operation, the detection of the frost on the outdoor side heat exchanger due to a drop in the temperature gradient of the indoor side heat exchanger is rendered inoperable.

Furthermore, according to the present invention, when the heavy load protecting function is activated, the set temperature of the indoor side heat exchanger for detecting frost on the outdoor side heat exchanger is raised by a predetermined value. It is determined that frosting has occurred and the defrosting operation is begun when (1) the air conditioner has been performing a reverse cycle heating operation for a predetermined total period of time or longer, (2) the foregoing set temperature of the indoor side heat exchanger for detecting the frost of the outdoor heat exchanger has been raised by the preset value, (3) the outdoor fan has been continuously stopped for a predetermined time or longer, and (4) the temperature of the indoor side heat exchanger has come down to the frosting detection temperature which has been raised as described above, or lower.

Thus, according to the present invention, when the outdoor fan is stopped by the heavy load protecting function, the indoor unit will not misjudge that the drop in the temperature gradient of the indoor side heat exchanger has been caused by frosting when it has actually been caused by the heavy load protecting function, thus allowing the heating operation to be continued.

According to the present invention, the defrosting start judgment standard at the time of heavy load is changed, and the indoor unit determines whether a drop in the temperature gradient of the indoor side heat exchanger is attributable to the heavy load protecting function in operation or frosting, and it disables the defrosting control when it decides that the heavy load protecting function is working, then it starts the defrosting control when a predetermined condition has been satisfied.

DESCRIPTION OF THE PREFERRED EMBODIMENTS

Figure 1:
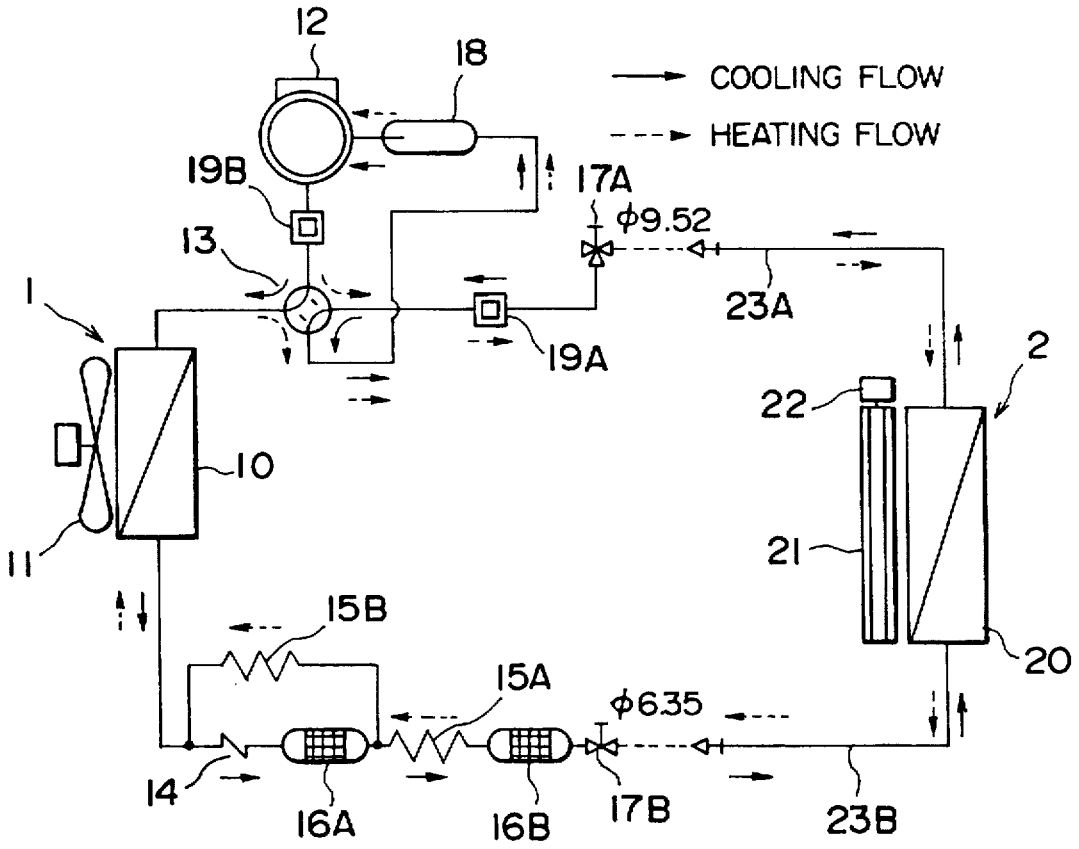
FIG. 1 is a block diagram of a two-unit-type air conditioner in accordance with the present invention.

The schematic configuration of a two-unit-type air conditioner to which the present invention is applied will be described in conjunction with FIG. 1.

The air conditioner is constructed by an outdoor unit I installed outdoors and an indoor unit 2 installed indoors; these two units are connected through refrigerant piping and a signal conductor.

Mounted on the outdoor unit 1 are an outdoor side heat exchanger (a heat source side heat exchanger) 10, an outdoor side fan 11 which is composed of a motor and a propeller fan to expedite the heat exchange between the outside air and the outdoor side heat exchanger 10, a compressor 12, a four-way valve 13 for switching the circulating direction of a refrigerant, a check valve 14 for regulating the circulating direction of the refrigerant, capillary tubes (expansion devices) 15A, 15B, strainers 16A, 16B, refrigerant pipe connecting ports 17A, 17B, an accumulator 18, mufflers 19A, 19B, and an outdoor side controller which will be discussed later.

The outdoor unit 1 does not have means such as a microcomputer; it carries out simple ON/OFF operation control. It is a simple type in which the outdoor unit 1 does not have a sensor for detecting a state.

Mounted on the indoor unit 2 are an indoor side heat exchanger (use side heat exchanger) 20, an indoor fan 21 composed of a fan motor 22 and a cross flow fan which is driven by the fan motor and returns the air, which has been heated or cooled by the indoor side heat exchanger 20, back into a room, refrigerant pipe connecting ports 23A, 23B, and an indoor side controller which will be discussed later.

The outdoor unit 1 and the indoor unit 2 provided with the component units described above constitute a single-system refrigerating cycle by connecting the port 17A with the port 23A through a refrigerant pipe having a diameter of 9.52 mm and by connecting the port 17B with the port 23B through a refrigerant pipe having a diameter of 6.35 mm as illustrated in FIG. 1.

When the four-way valve 13 is in the state shown in FIG. 1, the refrigerant discharged from the compressor 12 circulates in the direction indicated by solid-line arrows (cooling operation mode).

First, the high temperature, high pressure gaseous refrigerant discharged from the compressor 12 passes through the muffler 19B and the four-way valve 13 in order and reaches the outdoor side heat exchanger 10. Then, the outdoor side fan 11 blows air into the outdoor side heat exchanger 10 to cool the refrigerant and it condenses and liquefies in the outdoor side heat exchanger 10.

The refrigerant then passes through the check valve 14 and the strainer 16A before it reaches the capillary tube 15A. At this time, the refrigerant is squeezed by the capillary tube 15A, so that it has a low temperature and a high pressure. Then, the refrigerant goes through the strainer 16B, the port 17B, and the port 23B before it is supplied to the indoor side heat exchanger 20.

The indoor side heat exchanger 20 extends the piping passage through which the refrigerant circulates; therefore, the pressure in the indoor side heat exchanger 20 becomes low, causing the high-pressure refrigerant to evaporate and gasify. The heat of vaporization at that time lowers the temperature of the indoor side heat exchanger 20 and the cross flow fan 21 blows out air, thus cooling a room (indoor) to be air-conditioned.

The evaporated refrigerant passes through the port 23A, the port 17A, the muffler 19A, and the four-way valve 13 and reaches the accumulator 18. The accumulator 18 separates the refrigerant which has not gasified in the indoor side heat exchanger 20, i.e. liquid refrigerant, from gasified refrigerant, i.e. gaseous refrigerant, and it supplies only the gaseous refrigerant to the compressor 12. The compressor 12 recompresses the gaseous refrigerant to circulate it through the refrigerating cycle.

Thus, in the cooling operation mode, the refrigerant discharged from the compressor 12 condenses in the outdoor side heat exchanger 10 and evaporates in the indoor side heat exchanger 20 to exhaust the heat from the air-conditioned room to the outside, thereby enabling the air-conditioned room to be cooled.

In the heating operation mode, the four-way valve 13 is switched as indicated by dotted-line arrows shown in FIG. 1, and the refrigerant discharged from the compressor 12 circulates in the direction indicated by the dashed-line arrows in FIG. 1.

First, the high-temperature, high-pressure gaseous refrigerant discharged from the compressor 12 goes through the muffler 19B, the four-way valve 13, the muffler 19A, the port 17A, and the port 23A in order and reaches the indoor side heat exchanger 20.

Then, the cross flow fan 21 blows air into the indoor side heat exchanger 20 to cool the indoor side heat exchanger 20 which has been heated by the temperature of the refrigerant, and the refrigerant circulating inside condenses and liquefies. In other words, the cross flow fan 21 blows the air to the indoor side heat exchanger 20, which has been heated, so as to heat the air-conditioned room (indoor).

The liquefied refrigerant then goes through the port 23B, the port 17B, and the strainer 16B to reach the capillary tube 15A and the capillary tube 15B. At this time, the refrigerant is squeezed by the capillary tube 15A; therefore, it has a low temperature and a high pressure. The check valve 14 prevents the refrigerant from circulating through the strainer 16A.

Then, the refrigerant is supplied to the outdoor side heat exchanger 10. The outdoor side heat exchanger 10 extends the piping passage through which the refrigerant circulates; therefore, the pressure in the outdoor side heat exchanger 10 becomes low, causing the high-pressure refrigerant to evaporate and gasify. At this time, the outdoor fan 11 blows air to expedite the evaporation of the refrigerant.

The evaporated refrigerant is guided to the accumulator 18 via the four-way valve 13. The accumulator 18 separates the refrigerant which has not gasified in the outdoor side heat exchanger 10, i.e. liquid refrigerant, from gasified refrigerant, i.e. gaseous refrigerant, and it supplies only the gaseous refrigerant to the compressor 12. The compressor 12 recompresses the gaseous refrigerant to circulate it through the refrigerating cycle.

Thus, in the heating operation mode, the refrigerant discharged from the compressor 12 condenses in the indoor side heat exchanger 20 and evaporates in the outdoor side heat exchanger 10 to release the outdoor heat into the air-conditioned room, thereby enabling the heating of the room to be air-conditioned.

In this case, the indoor cooling or heating temperature can be maintained at a desired set temperature by microcomputer control according to the detection output of a temperature sensor disposed near the indoor fan 21.

As described above, it has been experimentally verified that, in the heating operation mode, when the operation of a typically designed refrigerating cycle is started with no frost on the outdoor side heat exchanger 10, no frost develops in a total of 50 minutes after the operation is begun, and, if the outdoor temperature is high and the refrigerating cycle is subjected to a heavy load, then the heavy load state is corrected when the outdoor fan 11 is halted continuously for about 10 minutes.

The heavy load state which has taken place in the refrigerating cycle is recognized by a rise in the temperature of the indoor side heat exchanger 20, while the frosting of the outdoor side heat exchanger 10 is recognized by a drop in the temperature of the indoor side heat exchanger 20. To be more specific, when the temperature of the indoor side heat exchanger 20 rises to a heavy load protecting operable temperature T1, the heavy load protecting operation, which will be discussed later, is triggered and it is terminated when the temperature comes down to a lower temperature T2. If the temperature of the indoor side heat exchanger 20 is not higher than a frosting detection temperature T3 which is lower than T2, and the temperature gradient (a temperature drop rate per predetermined time) has lowered down to a predetermined value or less, then the frosting of the outdoor side heat exchanger 10 is detected and the defrosting operation is begun.

To judge the frosting under a heavy load condition, the set temperature for the frosting detection is updated by raising it 13 degrees Celsius (T3 plus 13 degrees Celsius, which is higher than temperature T2), thereby permitting easier detection of frosting.

Hence, according to the present invention, in order to determine whether a drop in the temperature gradient of the indoor side heat exchanger 20 is attributable to frosting or heavy load, the indoor unit is adapted to decide that it has been caused by frosting rather than heavy load if the following four conditions are met:

(1) The set temperature for frosting detection has been increased by 13 degrees Celsius;

(2) A total of 50 minutes or more has passed since the heating operation was started;

(3) The outdoor fan 11 has been halted continuously for 10 minutes or more; and (4) The temperature of the indoor side heat exchanger 20 has come down to set temperature for the frosting detection plus 13 degrees Celsius or below.

If all of the four conditions above are satisfied, then the indoor unit decides that the drop in the temperature gradient has been caused by frosting rather than heavy load and it begins defrosting control.

Figure 2:
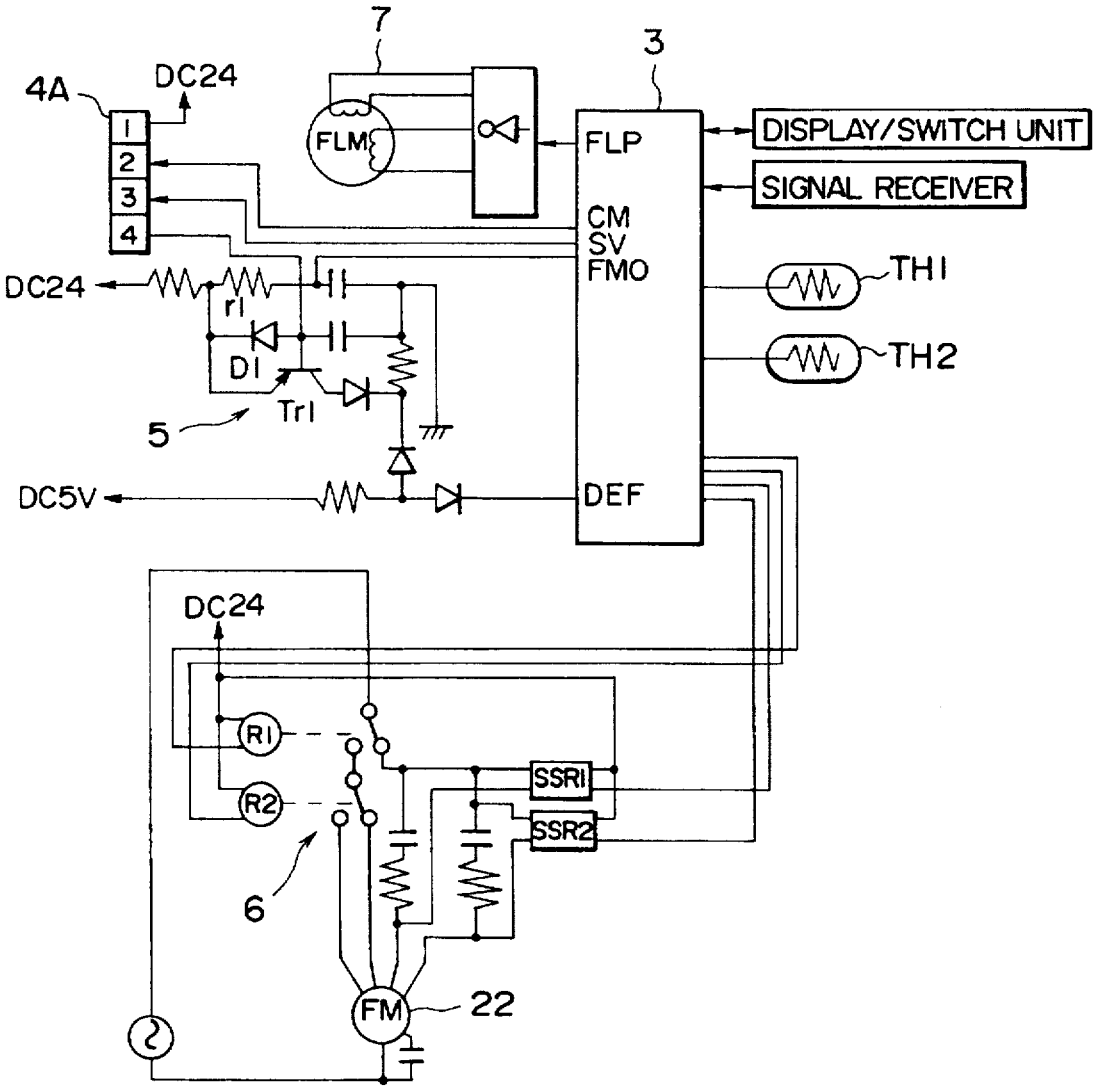
FIG. 2 is a diagram showing the electric circuit of the controller of an indoor unit.

FIG. 2 is a diagram showing an essential section of the electric circuit of the controller mounted on the indoor unit 2.

A microcomputer 3, e.g. TMS2600 made by INTEL, is provided with: and after "conditioner" insert switches for setting the basic mode of the air conditioner including a switch for selecting among power OFF, power ON, and test run, and a switch for displaying the brief history of failure for a service personnel, (2) an operation display unit for displaying the cooling operation mode, the heating operation mode, the cool air prevention, etc.; and (3) an interface for a signal receiver which receives a wireless signal from a remote controller, demodulates it, and sends a control code to the microcomputer.

The remote controller is used primarily to: turn ON/OFF the air conditioner; switch among the heating mode, the cooling mode, and the fan mode; set the room temperature; set the air blow by the room fan to high, medium, low, or automatic (H/M/L/auto); set the time on the timer to start or stop the operation; set the discharging direction of conditioned air, i.e. heated or cooled air, at a desired angle or for automatic setting; and detect the room temperature around the remote control and automatically send a value indicative of the room temperature to the signal receiver at predetermined intervals such as 2 to 3 minutes.

The microcomputer 3 controls the operation of the air conditioner according to the signals received from the remote controller. When the heating mode has been selected among the cooling mode, the heating mode, and the fan mode, the microcomputer 3 issues to the controller of the outdoor unit 1 a signal for turning ON the four-way valve 13, via a terminal No. 3 of a connector 4A to switch a high-level voltage to a low-level voltage; it judges the room temperature and the set temperature and supplies a signal for turning ON or OFF the compressor 12 to switch the high-level voltage to the low-level voltage or vice versa to the controller of the outdoor unit 1 via a terminal No. 2 of the connector 4A.

Further, the microcomputer 3 decides whether the compressor 12 is ON or OFF, the refrigerating cycle is in the heavy load condition, or the refrigerating cycle should implement defrosting, and it sends a signal for turning ON or OFF the outdoor fan 11 to switch the high-level voltage to the low-level voltage or vice versa according to the operating condition of the refrigerating cycle to the controller of the outdoor unit 1 via a terminal No. 4 of the connector 4A.

A stepping motor 7 changes the angle of an air blow changing plate to change the vertical discharging direction of conditioned air. The speed of the stepping motor 7 is reduced through a combination of reduction gears. A range of about 90 degrees is divided into 512 steps, and the stepping motor 7 is run in the forward or reverse direction by a desired number of steps by the microcomputer so as to change the angle of the air blow changing plate as desired.

Hence, when the microcomputer 3 switches the revolution of the stepping motor between the forward and reverse directions at a predetermined cycle, the discharging direction of conditioned air can be changed in succession, and therefore, this function is generally known as "swing."

A single-phase induction motor 22 drives the cross flow fan of the indoor fan 21; it is equipped with speed regulating terminals based on a selector circuit 6 for selection among high, medium, low, and very low (H/M/L/LL). The supply of current to these terminals is controlled by the microcomputer 3 through relays R1 and R2 which have selector armatures. The selection between low and very low (L and LL) is performed by the microcomputer 3 through electronic switches SSR1 and SSR2.

The microcomputer 3 controls the electronic switches according to the signals received from the remote controller. Further, when the air blow has been set for auto, the microcomputer automatically changes the air blow so that it increases as the room temperature goes away from a set temperature or it decreases as the room temperature comes closer to the set temperature. When the compressor 12 is at halt in the cooling operation mode or the heating operation mode, the air blow is set to low and it is set to very low during the defrosting operation.

TH1 and TH2 denote temperature sensors; TH1 is a thermistor installed to detect the temperature of the indoor side heat exchanger 20 and TH2 is a thermistor installed to detect the temperature of the room air sucked in by the room fan 21.

The temperature detected by the thermistor TH1 is used for detecting the frosting of the outdoor side heat exchanger in the heating operation mode and for starting the defrosting operation, preventing cool air in the heating operation mode, preventing the freezing in the cooling operation mode, and detecting the heavy load condition in the refrigerating cycle according to the flowchart which will be described later.

The temperature detected by the thermistor TH2 is compared with the room temperature sent from the remote controller and if the room temperature reported by the remote controller is determined to be abnormal (e.g. the remote controller is exposed to direct sunlight or to the air discharged from the air conditioner) or if no periodic reports are received from the remote controller (e.g. the transmitting section of the remote controller is in a shade or the remote controller is in a drawer or the like), the temperature detected by the thermistor TH2 is adopted as the room temperature.

A level detector circuit 5 functions to transmit an operation signal of the outdoor fan 11. When the outdoor fan 11 is at a halt, the output of a terminal FMO of the microcomputer 3 is high (H) level, +24 V, and a transistor Tr1 is OFF, the potential between a diode and a capacitor being substantially +24 V.

When the output of the terminal FMO switches to low (L) level (nearly 0 V), the terminal No. 4 of the connector is connected to the earth level (0 V) via a resistor and the diode. At this time, the transistor Tr1 stays OFF. More detail will be given in the description of the controller of the outdoor unit 1.

Figure 3:
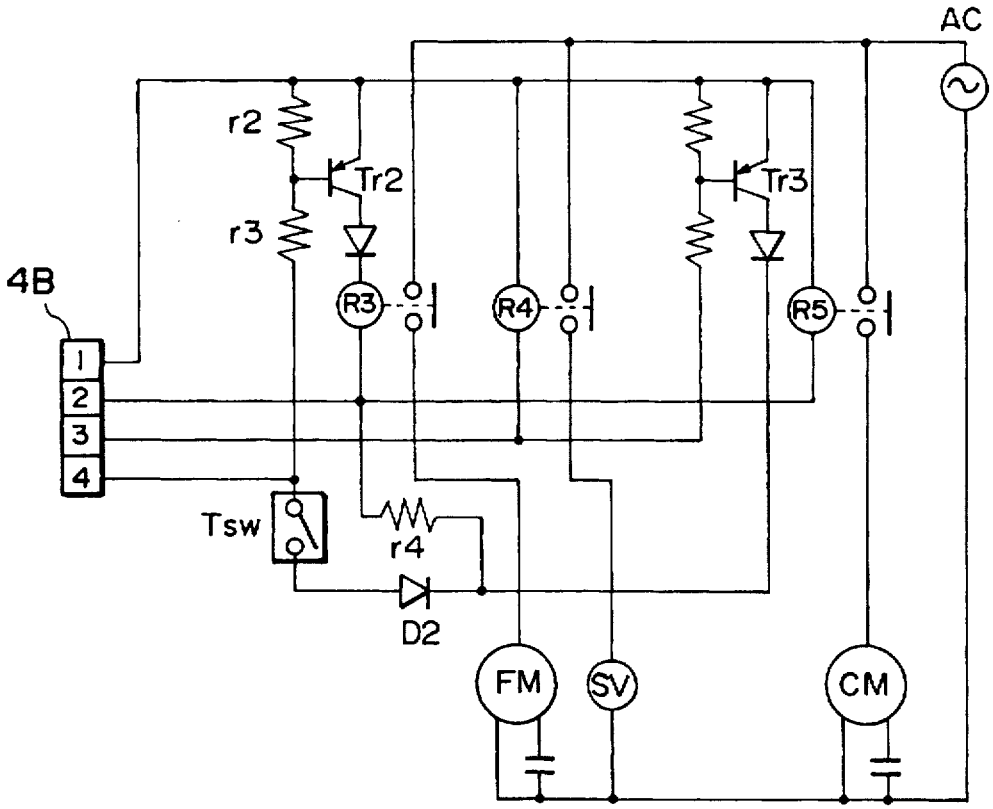
FIG. 3 is a diagram showing the electric circuit of the controller of an outdoor unit.

FIG. 3 is a diagram showing the essential section of the electric circuit of the controller of the outdoor unit 1. In the circuit diagram, the terminals of a connector 4B are connected to the corresponding terminals of the connector 4A, matching like terminal numbers, of the controller of the indoor unit 2 shown in FIG. 2.

Current is supplied to a compressor CM when the terminal No. 2 of the connector 4B is switched to the L level voltage, causing a relay R5 to be energized to close the normally open armature thereof. A single-phase induction motor is employed to drive the compressor 12 as shown in the drawing. A fan motor FM is a single-phase induction motor; when the normally open armature of a relay R3 is closed, single-phase AC power is supplied to the fan motor FM to run it.

As shown in the drawing, the relay R3 is energized and the normally open armature thereof is closed when the terminal No. 2 of the connector 4B is at the L-level voltage, that is, when the terminal No. 4 of the connector 4B is switched to the L-level voltage while the compressor 12 is in operation and the transistor Tr2 is turned ON.

A solenoid SV switches the state of the four-way valve; when it is energized, the state of the four-way valve 13 is switched from the one indicated by the solid line to the one indicated by the dashed line as shown in FIG. 1. Hence, the refrigerating cycle shown in FIG. 1 is set to the heating operation mode when the solenoid SV is energized, while it is set to the cooling operation mode when the solenoid SV is de-energized.

The solenoid SV is energized when a relay R4 is energized and the normally open armature thereof is closed. The relay R4 is energized when the terminal No. 3 of the connector 4B is switched to the L-level voltage.

A temperature switch Tsw detects the temperature of the outdoor side heat exchanger 10; it has a predetermined ON/OFF differential and closes the armature thereof when the temperature of the outdoor side heat exchanger 10 has reached a predetermined abnormal level (e.g. +12 degrees Celsius or more).

When the air conditioner has been set to the cooling operation mode, that is, when the terminal No. 3 of the compressor 4B is at the H-level voltage and no current is being supplied to the solenoid SV for switching the four-way valve, the outdoor side heat exchanger 10 works as a condenser of the refrigerant. The condensing temperature of the refrigerant is usually +40 degrees Celsius or higher and the temperature of outside air is 12 degrees Celsius or higher; therefore, the temperature switch Tsw stays closed.

Under such a condition, when the controller of the indoor unit 2 issues a signal for turning the compressor 12 ON, i.e. a signal for switching the terminal NO. 2 of the connector 4B to the L-level voltage, the relay R5 is energized and the compressor 12 is actuated via the normally open armature of the relay R5.

At the same time, the terminal No. 4 of the connector 4B is connected to the L-level voltage via a resistor r1 and a diode D1 of the controller of the indoor unit 2. At this time, a series circuit of the resistor r1 and the diode D1 is connected in parallel to a series circuit of a resistor r4 and a diode D2 via the temperature switch Tsw.

Hence, the potential at the terminal No. 4 of the connector is the value divided by a resistor r2, a resistor r3, and the resistor r4. This potential is capable of turning the transistor Tr2 ON, so that the relay R3 is energized to run the fan motor FM. As previously described, the compressor 12 and the fan motor 11 are actuated according to the result of the comparison between the room temperature and the set temperature.

At this time, if the refrigerating cycle incurs a heavy load, condition the terminal FMO of the microcomputer 3 of the indoor unit 2 is switched to the H-level voltage (+24 V) and the terminal No. 4 of the connector 4B is also switched to the H-level voltage at the same time; therefore, the transistor Tr2 is turned OFF, causing the fan motor 11 to stop. This should release the refrigerating cycle from the heavy load.

If this control fails to solve the heavy load condition of the refrigerating cycle, then the heavy load causes an increase in the current flowing into the compressor 12, causing an overcurrent detector (not shown) built in the compressor 12 to be actuated to stop the compressor 12 thereby protecting the refrigerating cycle.

When the air conditioner is set for the heating operation mode, the terminal No. 3 of the connector 4B is switched to the L-level voltage and the relay R4 is energized and the solenoid SV for switching the four-way valve is energized. This causes the state of the four-way valve 13 to change to the one indicated by the dashed-line arrows shown in FIG. 1, thus setting the refrigerating cycle for the heating operation mode. At this time, if the room temperature is lower than the set temperature, then the terminal No. 2 of the connector 4B is switched to the L-level voltage and the relay R5 is energized to actuate the compressor 12.

At the same time, the terminal FMO of the microcomputer 3 of the controller of the indoor unit 2 is switched to the L-level voltage and the temperature of the indoor side heat exchanger 20 is increased as the compressor 12 operates to enable the heating operation; the indoor fan 21 is forcibly set for a low speed to prevent cool air from being emitted until the indoor side heat exchanger 20 reaches a predetermined temperature, approximately +35 degrees Celsius.

It is generally known that continued heating operation when the temperature of the outside air is low causes the outdoor side heat exchanger 10 to be frosted. If the outdoor side heat exchanger 10 is frosted, the efficiency of heat exchange between the outdoor side heat exchanger 10 and the outside air is deteriorated, causing the temperature of the indoor side heat exchanger 20 to go down. From this temperature change, the microcomputer 3 of the indoor unit 2 recognizes the frosting of the outdoor side heat exchanger 10.

As soon as the microcomputer 3 identifies the frosting, it changes the setting of the four-way valve 13, i.e. de-energizes the four-way valve, to set the refrigerating cycle for the cooling operation and also sets the outdoor side heat exchanger 10 so that it works as the condenser, thus melting the frost on the outdoor side heat exchanger 10 by the heat of condensation of the refrigerant. At this time, the terminal No. 4 of the connector 4B is switched to the H-level voltage and the relay R3 is de-energized to stop the fan motor FM.

The temperature of the outdoor side heat exchanger 10 rises as the outdoor side heat exchanger 10 works as the condenser, with the outdoor fan 11 at a halt. The rise in the temperature melts the frost on the outdoor side heat exchanger 10, and when the temperature of the outdoor side heat exchanger 10 further rises until it reaches +12 degrees Celsius or more, the temperature switch Tsw closes. This causes the resistor r4 and the diode D2 to be connected to the terminal No. 4 of the connector 4B and the potential of the terminal No. 4 of the connector 4B drops.

The drop in the potential in turn causes the transistor Tr1 of the controller of the indoor unit 2 to be turned ON. The value of the resistor is set so that the base voltage of the transistor Tr1 stays +24 V−0.7 V (the voltage in the forward direction of the PN junction) or less even when the transistor turns ON. The voltage divided through the resistors is applied to a terminal DEF of the microcomputer 3.

This voltage is higher than that obtained when the transistor Tr1 is OFF; therefore, the microcomputer 3 judges that the armature of the temperature switch Tsw has been closed when the voltage applied to the terminal DEF is higher. In other words, the microcomputer 3 determines that the temperature of the outdoor side heat exchanger 10 has risen and the defrosting has been completed. On completion of the defrosting, the four-way valve 13 is energized again and the fan motor FM is restarted to resume the heating operation.

Figure 4:
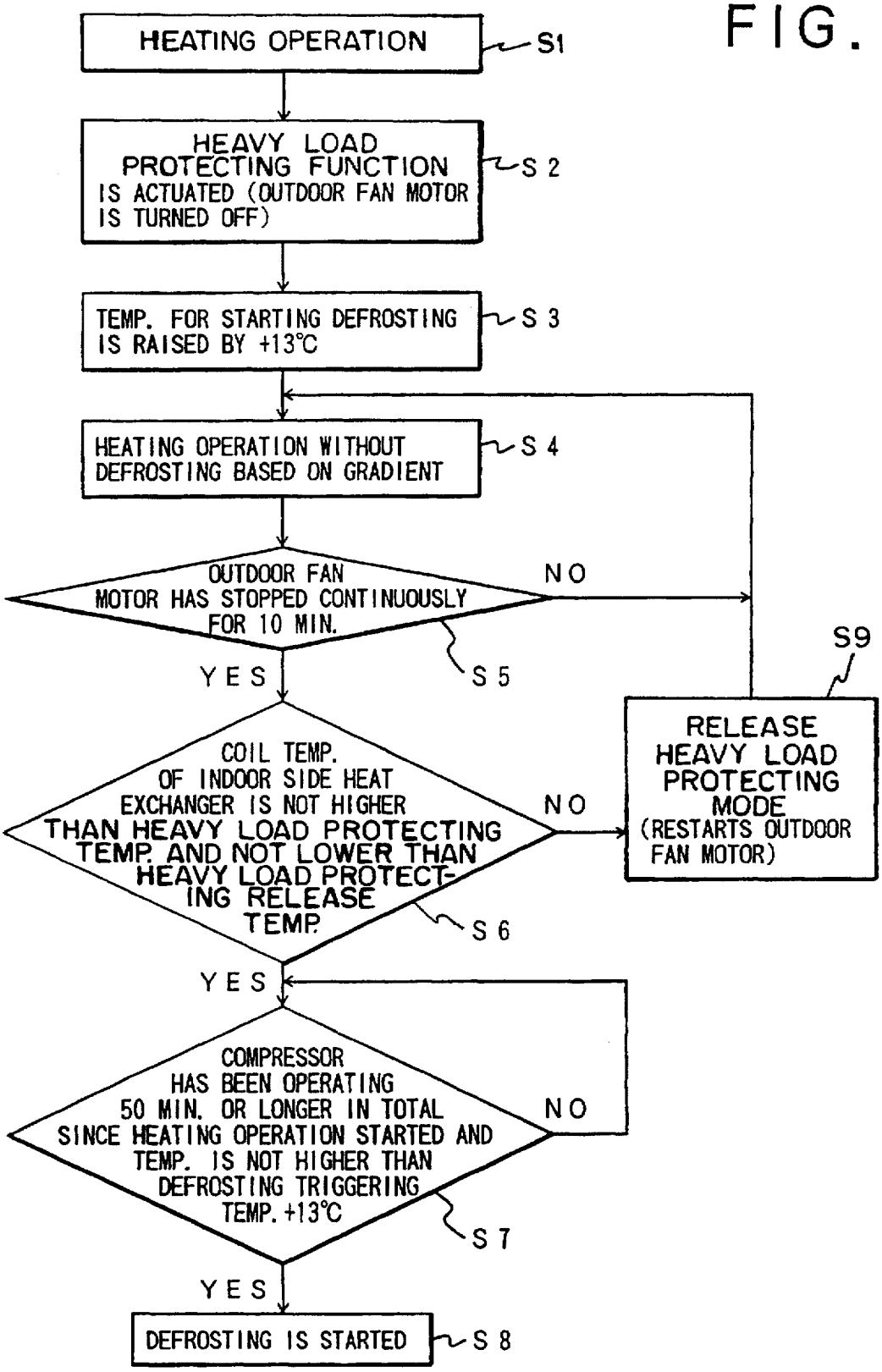
FIG. 4 is a flowchart illustrative of the process for distinguishing between heavy load and frosting.

Referring now to the flowchart shown in FIG. 4, the judging procedure for the defrosting control will be described.

During the heating operation of a step S1, if the heavy load protecting function is actuated in a step S2, then the outdoor fan 11 is stopped and the rotational speed of the indoor fan 21 is increased.

At the same time, the set temperature for detecting frost or for the defrosting control is raised by +13 degrees Celsius in a step S3. Then in a step S4, the heating operation is continued without conducting the defrosting control, ignoring the drop in the temperature gradient of the indoor side heat exchanger 20. This prevents the defrosting control from being carried out while the heavy load protecting function is in operation.

In a step S5, the microcomputer 3 determines whether the outdoor fan 11 has been continuously halted for 10 minutes; if it decides that the outdoor fan 11 has not been halted for 10 minutes continuously, then it goes back to the step S4 where it repeatedly continues the heating operation.

If the microcomputer 3 determines that the outdoor fan 11 has been halted for 10 minutes with no break, then it further determines in a step S6 whether the coil temperature of the indoor side heat exchanger 20 is the temperature T1, which is applied during the heavy load protecting operation, or lower and the temperature T2, which is applied when the heavy load protecting operation mode has been cleared, or higher at the same time.

If the determination result in the step S6 is negative, then the microcomputer 3 clears the heavy load protecting operatable mode and restarts the outdoor fan 11 in a step S9, then it goes back to the step S4 wherein it repeatedly continues the heating operation.

If the determination result in the step S6 is affirmative, then the microcomputer 3 decides in a step S7 whether a total of 50 minutes has elapsed since the heating operation was started and whether the temperature is the set temperature T3 for detecting frost plus 13 degrees Celsius or lower. If the judgment result in the step S7 is negative, then the microcomputer 3 repeats judgment in the step S7 again.

It is assumed that the temperature T1 of the indoor side heat exchanger 20 at which the heavy load protecting mode is triggered is higher than the temperature T2 at which the heavy load protecting mode is released, the set temperature T3 of the indoor side heat exchanger 20 for detecting the frost on the outdoor side heat exchanger 10 is lower than the temperature T2, and T3 plus 13 degrees Celsius is higher than the temperature T2.

If the judgment result in the step S7 is affirmative, then the microcomputer 3 decides in a step S8 that the outdoor side heat exchanger 10 has been frosted and begins the defrosting control. This means that the defrosting control is started as soon as the conditions described in (1) through (4) above are satisfied even when the heavy load protecting function is in operation.

Thus, according to the present invention, once the heavy load protecting function is actuated, the defrosting control is disabled. If no frosting is identified after the heavy load condition has been cleared, then the defrosting control is not carried out even when, for example, a drop in the temperature gradient of the indoor side heat exchanger 20 is detected.

Therefore, the present invention makes it possible to eliminate the chance of misjudging a drop in the temperature gradient of the indoor side heat exchanger, which is caused by the heavy load protecting function being in operation, as a sign of frosting even when the outdoor fan is stopped by the heavy load protecting function while a two-unit-type air conditioner is performing a reverse cycle heating operation. This enables the heating operation to be continued.

Furthermore, when a heavy load state occurs, the condition for starting the defrosting control is changed, and the indoor unit decides whether a drop in the temperature gradient of the indoor side heat exchanger is due to the heavy load protecting function being in operation or frosting. If the indoor unit determines that the drop in the temperature gradient is attributable to the heavy load protecting operation, then it prevents the defrosting control from being triggered, and it begins the defrosting control when the predetermined updated conditions are satisfied. Thus, highly efficient defrosting control can be achieved even when using a simple type outdoor unit which is not provided with a microcomputer or other similar means and therefor not capable of detecting the heavy load state or frosting, that is, it merely turns ON/OFF the induction motor for driving the compressor.

What is claimed is:

1. A method for controlling defrosting in a two-unit-type of air conditioner with refrigerant conduits connecting an indoor side heat exchanger and indoor fan to an outdoor side heat exchanger and fan, wherein, in a forward cycle cooling operation the indoor side heat exchanger and fan provide cooling air to a room and in a reverse cycle heating operation the inside heat exchanger and fan provide heated air to the room, comprising the steps of:

providing an indication of a heavy load condition during a reverse cycle heating operation by detecting when the temperature of the indoor side heat exchanger has risen to a predetermined load temperature;

initiating a heavy load protection function by stopping the outdoor fan and increasing the number of revolutions per unit time of the indoor fan in response to the indication a heavy load condition;

determining the end of a heavy load condition during a heavy load protection function by sensing when the temperature of said indoor side heat exchanger has dropped to a predetermined release temperature;

disengaging said heavy load protection function in response to determining the end of a heavy load condition;

providing an indication of frosting of said outdoor heat exchanger by determining when said indoor side heat exchanger is at or below a predetermined set frost detecting temperature and the temperature gradient of the indoor side heat exchanger has dropped to or below predetermined value; and starting a defrosting function for the outside heat exchanger in response to the indication of frosting.

2. A method for controlling defrosting according to claim 1, wherein during a heavy load protection function, the step of providing an indication of frosting is inhibited.

3. A method for controlling defrosting according to claim 2, wherein during a heavy load protection function the predetermined set frost detecting temperature is raised by a certain temperature value, and wherein the step of providing an indication of frosting further includes the steps of:

determining when a first period of time during which the air conditioner has been performing the reverse cycle heating operation is equal to or exceeds a first certain value;

determining when a second period of time during which the outdoor fan has been continuously stopped during a heavy load protection function is equal to or exceeds a second certain value; p1 determining when the temperature of the indoor side heat exchanger has come down to the raised frost detecting temperature, and providing the indication of frosting only when the first period of time is equal to or exceeds the first certain value, the second period of time is equal to or exceeds the second certain value, and the temperature of the indoor side heat exchanger is below the raised frost detecting temperature.

4. A method for controlling defrosting according to claim 3, wherein the first certain value is 50 minutes, the second certain value is 10 minutes and the certain temperature value is 13 degrees.

* * * * *